United States Patent [19]

Barlow

[11] 4,128,442

[45] Dec. 5, 1978

[54] EMULSIFIED METHANOL CONTAINING EXPLOSIVE COMPOSITION

[75] Inventor: Kenneth N. Barlow, Kempton Park, South Africa

[73] Assignee: AECI Limited, Johannesburg, South Africa

[21] Appl. No.: 879,493

[22] Filed: Feb. 21, 1978

[30] Foreign Application Priority Data

Feb. 23, 1977 [ZA] South Africa ..... 77/1069

[51] Int. Cl.[2] ..... C06B 31/28

[52] U.S. Cl. ..... 149/46; 149/42; 149/44; 149/45; 149/61; 149/83

[58] Field of Search ..... 149/46, 44, 60, 75, 149/83, 77

[56] References Cited

U.S. PATENT DOCUMENTS 3,465,675 9/1969 Bronstein ..... 149/44 X

*Primary Examiner*—Stephen J. Lechert, Jr.

*Attorney, Agent, or Firm*—Cushman, Darby & Cushman

[57] ABSTRACT

A non-aqueous slurry explosive composition comprising an oxidizing salt component, a fuel component, methanol and a metal nitrate or perchlorate soluble in the methanol. Such compositions are highly sensitive and useful in the form of small diameter cartridges.

7 Claims, No Drawings

EMULSIFIED METHANOL CONTAINING EXPLOSIVE COMPOSITION

This invention relates to explosive compositions of the type known as "slurry" explosive compositions.

"Slurry" explosive compositions are known which comprise an oxidising salt component, a fuel component dispersed or dissolved in a liquid carrier, which may be thickened to a desired consistency by means of a suitable thickener or gelling agent, and a sensitiser component for increasing the sensitivity of the composition to initiation. These slurry compositions are further generally aerated to increase their sensitivity this being effected for example mechanically or by inclusion in the composition of suitable gas generating compositions. Generally the liquid carrier is substantially aqueous, and on detonation a significant proportion of the energy released is consumed in evaporating this water. Some attempts have been made to employ non-aqueous carriers, but these have for various reasons generally not proved particularly successful.

According to the present invention there is provided a non-aqueous slurry explosive composition comprising an oxidising salt component, a fuel component, methanol and a metal nitrate or perchlorate soluble in methanol.

The oxidising salt is predominantly ammonium nitrate, although other suitable oxidising salts may be employed.

The metal nitrate or perchlorate may for example be a nitrate of copper, manganese or calcium or a perchlorate of lithium or calcium.

The fuel component may be any conventional fuel used in explosive compositions such as, for example, aluminium, sulphur or solid carbonaceous vegetable products such as oathusk meal, sawdust, etcetera. Generally the total amount of fuel and oxidising salts are adjusted so that the total composition has an oxygen balance of between −5% and +5%.

The composition is generally aerated, gas bubbles being provided for density control by any convenient means, for example mechanical aeration, inclusion of microballoons or a suitable gas producing compound or the inclusion of a foaming surfactant paste. This paste consists of the ammonium or sodium salt of ethoxylated lauryl alcohol sulphate and a bubble stabiliser such as a long chain hydrocarbon amine.

Further conventional components, such as thickeners may be added as desired to thicken or gel the liquid phase, for example, galactomannans, usually in amount 0.3% to 3% of the total weight of composition. They can be crosslinked with normal crosslinking agents used in aqueous slurry explosives, for example, borax, potassium dichromate and potassium antimony tartrate to make the slurry waterproof. Additional thickening agents may be incorporated, such as hydroxy ethyl cellulose and pregelatinized starch.

The proportions of the various components of the total composition may be varied over relatively wide ranges but generally the oxidising salt will be in the range 40 to 75% by weight, the methanol 6 to 15% by weight and the metal nitrate or perchlorate soluble therein, 10 to 20% by weight but the latter figure may in some instances be as high as 30%.

The following Examples illustrate some typical compositions of the invention, without limiting its scope in any way.

EXAMPLE 1

An explosive composition was prepared by mixing together the following components on a % by weight basis:

| | |
|---|---|
| ammonium nitrate | 65,8 |
| cupric nitrate | 20,0 |
| methanol | 9,0 |
| gassing paste* | 0,6 |
| atomised aluminium | 2,0 |
| gum | 0,6 |
| oathusk meal | 2,0 |

(*paste comprising 66% "ELFAN" NS243 (Trade Mark), an ethoxylated lauryl sulphate marketed by Highveld Chemicals Ltd, 23% "ARMEEN" HF (Trade Mark), prepared from hardened fish oil comprising primarily a $C_{20}$ amine, and marketed by ARMAK CO., and 11% water.)

The minimum detonator at 24° C. was found to be 0.36 g PETN (nitropentaerythrite).

The density was measured as 1.1 g/cc.

The minimum diameter was found to be less than 25 mm.

EXAMPLES 2 and 3

Similar compositions were prepared, except the cupric nitrate was replaced by lithium perchlorate in the one case, and calcium perchlorate in the other. Details of the compositions, and characteristics, are tabulated below (all compositions on a % by weight basis):

| | |
|---|---|
| ammonium nitrate | 65,5 |
| lithium perchlorate (calcium perchlorate) | 18,0 |
| methanol | 10,0 |
| gassing paste | 0,6 |
| gum | 0,6 |
| oathusk meal | 5,3 |
| minimum detonator | 2,06 (0,18) g PETN |
| temperature | 25° C |
| density | 1,1 g/cc |

In both cases the minimum diameter was again below 25 mm.

EXAMPLES 4, 5 and 6

Three further examples of explosive compositions according to the invention are given in the table below:

TABLE

| | | | |
|---|---|---|---|
| ammonium nitrate | 66,65 | 72,04 | 69,57 |
| methanol | 9 | 9 | 8 |
| sodium nitrate | 0 | 0 | 0 |
| copper nitrate | 16 | 10 | 14 |
| calcium nitrate | 4 | 5 | 5 |
| paste | 0,3 | 0,3 | 0,3 |
| gum + crosslinker | 0,6 | 0,6 | 0,66 |
| atomised aluminium | 2,0 | 2,0 | 0 |
| Gilsonite | 1,45 | 1,06 | 2,47 |
| density ($Mg/m^3$) | 1,15 | 1,15 | 1,15 |
| temperature | 12° C | 10° C | 10° C |
| diameter | 25 mm | 25 mm | 25 mm |
| minimum detonator (g PETN) | 0,09 | 0,18 | 0,36 |

The above results show that the above compositions are all highly suitable explosive compositions.

What I claim is:

1. A non-aqueous slurry explosive composition comprising an oxidising salt component, a fuel component, methanol and a metal nitrate or perchlorate soluble in the methanol.

2. An explosive composition as claimed in claim 1 wherein the oxidising salt component is ammonium nitrate.

3. An explosive composition as claimed in claim 1 wherein the metal nitrate or perchlorate is selected from nitrates of copper, manganese and calcium and perchlorates of lithium and calcium.

4. An explosive composition as claimed in claim 1 wherein the oxidising salt component is present in an amount in the range 40 to 75% by weight.

5. An explosive composition as claimed in claim 1 wherein the methanol is present in an amount in the range 6 to 15% by weight.

6. An explosive composition as claimed in claim 1 wherein the metal nitrate or perchlorate is present in an amount up to 30% by weight.

7. An explosive composition as claimed in claim 6 wherein the metal nitrate or perchlorate is present in an amount in the range 10 to 20% by weight.

* * * * *